US010233591B2

(12) United States Patent
Cella Mazzariol et al.

(10) Patent No.: US 10,233,591 B2
(45) Date of Patent: Mar. 19, 2019

(54) METHOD AND PLANT FOR PRE-TREATING BIOMASSES

(71) Applicant: Entsorgafin S.P.A., Tortona (AI) (IT)

(72) Inventors: Pietro Paolo Cella Mazzariol, Tortona (IT); Gian Francesco Galanzino, Tortona (IT)

(73) Assignee: Entsorgafin S.P.A., Tortona (al) (IT)

( * ) Notice: Subject to any disclaimer, the term of this patent is extended or adjusted under 35 U.S.C. 154(b) by 0 days.

(21) Appl. No.: 15/511,672

(22) PCT Filed: Sep. 18, 2015

(86) PCT No.: PCT/IB2015/057204
§ 371 (c)(1),
(2) Date: Mar. 16, 2017

(87) PCT Pub. No.: WO2016/042529
PCT Pub. Date: Mar. 24, 2016

(65) Prior Publication Data

US 2017/0247832 A1 Aug. 31, 2017

(30) Foreign Application Priority Data

Sep. 19, 2014 (IT) ..... TO2014A0741

(51) Int. Cl.

| | |
|---|---|
| ***D21C 1/02*** | (2006.01) |
| ***D21B 1/02*** | (2006.01) |
| ***D21B 1/06*** | (2006.01) |
| ***D21B 1/12*** | (2006.01) |
| ***B03C 1/20*** | (2006.01) |
| ***B07B 4/00*** | (2006.01) |
| ***B07B 9/00*** | (2006.01) |

(52) U.S. Cl.
CPC ..... *D21C 1/02* (2013.01); *B03C 1/20* (2013.01); *B07B 4/00* (2013.01); *B07B 9/00* (2013.01); *D21B 1/02* (2013.01); *D21B 1/026* (2013.01); *D21B 1/061* (2013.01); *D21B 1/12* (2013.01); *B03C 2201/20* (2013.01)

(58) Field of Classification Search
USPC ..... 162/24
See application file for complete search history.

(56) References Cited

U.S. PATENT DOCUMENTS

| | | | |
|---|---|---|---|
| 2011/0111456 | A1 | 5/2011 | Medoff |
| 2012/0037325 | A1 | 2/2012 | Beldring et al. |
| 2013/0181076 | A1 | 7/2013 | De Feraudy et al. |

FOREIGN PATENT DOCUMENTS

| | | | |
|---|---|---|---|
| EP | 0175128 | A1 | 3/1986 |

*Primary Examiner* — Mark Halpern
(74) *Attorney, Agent, or Firm* — Howson & Howson LLP

(57) ABSTRACT

A method is provided for pre-treating biomasses, more particularly, for pre-treating biomasses intended for a biorefinery or similar facility for producing biofuels. The method comprises the steps of shredding the biomasses, removing foreign bodies contained in the biomasses upstream of the step of shredding, and soaking the biomasses by immersing the biomasses in water upstream or downstream of the shredding step. A plant for pre-treating biomasses is also provided. The plant comprises a shredding station for shredding biomasses, a station for removing foreign bodies from the biomasses upstream of the shredding station, and a soaking station for soaking the biomasses upstream or downstream of the shredding station.

8 Claims, 3 Drawing Sheets

METHOD AND PLANT FOR PRE-TREATING BIOMASSES

This application is a 371 of PCT/IB2015/057204 filed 18 Sep. 2015

TECHNICAL FIELD

The present invention relates to a method for pre-treating biomasses, more particularly for pre-treating biomasses intended for a biorefinery or similar facility for producing biofuels. The present invention further relates to a plant for pre-treating biomasses capable of implementing said method.

PRIOR ART

Biorefineries in which biofuels are obtained from biomasses through a fermentation process are known.

In particular, it is known to produce bioethanol by fermentation starting from biomasses. In current biorefineries, bioethanol is obtained starting from biomasses deriving from sugar-rich agricultural products. For example, sugarcane, corn, sunflower and soy are raw materials widely used for the production of bioethanol.

However, use of said crops for producing biofuels is being increasingly criticized as it subtracts resources from the food industry.

In recent times, attempts have been made at obtaining biofuels, particularly bioethanol, starting from the cellulose contained in non-food masses such as for instance wheat straw or rice straw and other agricultural waste materials.

Furthermore, cellulose is a raw material of great interest non only for producing bioethanol, but more generally for the entire field of the so-called "green chemistry". However, at present bioethanol production from cellulose appears to be too expensive and non-competitive from an economic viewpoint when compared with the production starting from agricultural crops.

The main difficulties in producing bioethanol from cellulose lie in the preparatory steps of pre-treatment of raw materials rather than in the process of cellulose fermentation.

Indeed, in order to make cellulose available for the fermentation process and expose it to the microorganisms responsible for such fermentation process, it is necessary to separate cellulose from lignin.

Such separation can take place according to different methods: chemo-physically (for instance by "steam cracking"), thermally (for instance by gasification), enzymatically. Whatever the separation method may be, the raw materials must be homogenized and purified from possible contaminants such as rocks, stones, soil, metal pieces and so on.

In currently known plants, non-food biomasses such as wheat straw and/or rice straw fed in bales are freed from straps and shredded, for example by using a hammer shredder. However, this solution of the known type involves a series of drawbacks.

First of all, the presence of foreign bodies (stones, rocks, metal scraps and the like) inside the biomasses involves the risk of jamming and failure, thus limiting plant reliability, and also causes quick wear of the used shredding devices.

Secondly, during shredding, an excessive quantity of dusts is created, which is a remarkable problem during the subsequent processing steps.

Furthermore, the size grade of the material after shredding is non-homogeneous and the presence of unshredded straw stalks (which may be up to 150 cm long) involves problems and inefficiencies in the subsequent processing steps.

The document EP 175 128 describes a method and an arrangement for pre-treating paper in which a step of paper disintegration, a step of removal of foreign bodies and a step of paper wetting by spraying are provided upstream of the paper shredding step.

However, the method and the arrangement described in EP 175 128 are not suitable for treating straw stalks and other biomasses useful for producing bioethanol; in particular, they are not suitable for preparing biomasses for the subsequent processing steps, especially for the step of separating cellulose from lignin.

The document US 2011/0111456 describes methods and arrangements for treating biomasses, for instance for obtaining bioethanol. The methods and arrangements described therein may provide for an initial preparation for reducing size of the treated biomasses and making it more homogeneous. However, during said preparation the biomasses are shredded without any previous removal of foreign bodies; sieving of the treated biomasses and removal of the foreign bodies that may be present takes place simultaneously with or subsequently to shredding. As a consequence, the described methods and arrangements do not solve the technical problem posed by the risk of failures and malfunctioning of the shredding devices.

The aforementioned difficulties related to the pre-treatment of biomasses have heretofore strongly limited the production of bioethanol from cellulose.

In this respect, it is to be noted that such difficulties are further amplified by the need to treat high flowrates of biomasses, usually comprised between 20 and 50 t/h of dry matter.

The main object of the present invention is therefore to overcome the aforementioned drawbacks so that the production of cellulose-derived biofuels—particularly of bioethanol—becomes more desirable and cost convenient.

In particular, an object of the invention is to provide a method for pre-treating biomasses, especially, though not exclusively, non-food biomasses intended for a biorefinery or similar facility, which allows to provide biomasses in optimum conditions for subsequent processing.

Another object of the invention is to provide a plant for pre-treating biomasses that is capable of implementing the aforementioned method.

These and other objects are achieved by the method and plant for pre-treating biomasses as claimed in the appended claims.

SUMMARY OF THE INVENTION

The method for pre-treating biomasses according to the invention comprises a step of shredding the biomasses and, upstream of said shredding step, a step of soaking the biomasses and simultaneously removing foreign bodies from said biomasses.

In particular, said step of removing foreign bodies provides for removing both light foreign bodies (dusts) and heavy foreign bodies (wood pieces, rocks, stones, sands, metal scraps).

Specific measures may possibly be further provided for magnetically removing ferrous foreign bodies.

A subsequent soaking step is further provided, either upstream of downstream of said shredding step.

Indeed, a step of soaking the biomasses with water, preferably having a high-temperature and possibly mixed with appropriate chemical compounds (such as for instance ammonia), allows to further separate some substances (such as for instance silica and waxes) that are undesirable for the subsequent processing steps and facilitates destruction of the structure of the biomasses themselves, thus promoting exposure of the cellulose contained therein.

In addition, during such soaking step very fine foreign bodies, such as for instance powders, which may still be present after the step of removing foreign bodies in a dry manner, can be removed.

In the case where biomasses are provided in bales (for instance in the case of wheat straw and/or rice straw), the step of removing foreign bodies is preferably preceded by a step of disintegrating the bales and spreading the treated biomasses on the belt so as to allow maximum exposure of the materials to the subsequent treatments. In addition, a preliminary step of removing straps from the bales may be provided in a manner known per se.

Advantageously, according to a preferred embodiment of the invention, the step of shredding the biomasses is a step of shredding by cutting, which ensures higher homogeneity in the size of the material exiting said step with respect to the one obtainable with a shredding by means of hammer shredders.

The invention further relates to a plant for pre-treating biomasses which comprises a station for shredding biomasses and a station for removing foreign bodies from said biomasses, the latter being arranged upstream of said shredding station.

Said station for removing foreign bodies in the plant according to the invention preferably provides for separate sub-stations for removing light foreign bodies and for removing heavy foreign bodies.

A separate sub-station comprising magnetic means for removing ferrous foreign bodies may possibly be further provided.

The plant for pre-treating biomasses according to the invention further comprises, upstream or downstream of said shredding station, a station for soaking biomasses.

In the case where biomasses are provided in bales, the station for removing foreign bodies is preferably preceded by a preliminary station for removing straps from the bales and by a station for disintegrating the bales.

Advantageously, according to a preferred embodiment of the invention, the shredding station comprises a blade shredder o similar cutting device, which ensures higher homogeneity in the size of the material exiting said station.

BRIEF DESCRIPTION OF THE DRAWINGS

Further features and advantages of the invention will become more apparent from the following detailed description of some preferred embodiments of the invention, given by way of non-limiting example with reference to the annexed drawings, in which.

DESCRIPTION OF A PREFERRED EMBODIMENT OF THE INVENTION

A preferred embodiment of the invention will be described in detail hereafter.

Such embodiment should not be intended as limiting the scope of protection of the present invention.

In particular, although hereafter reference is made to the pre-treatment of wheat straw and/or rice straw provided in bales, the invention can be equally applied to biomasses of a different nature.

In addition, although hereafter reference is made to the pre-treatment of biomasses for application to biorefineries for producing biofuels (for instance bioethanol), the invention can be equally applied to the pre-treatment of biomasses intended for other purposes, for which it may be deemed necessary or convenient that said biomasses have a homogeneous size and are free from foreign bodies.

Figure 1:
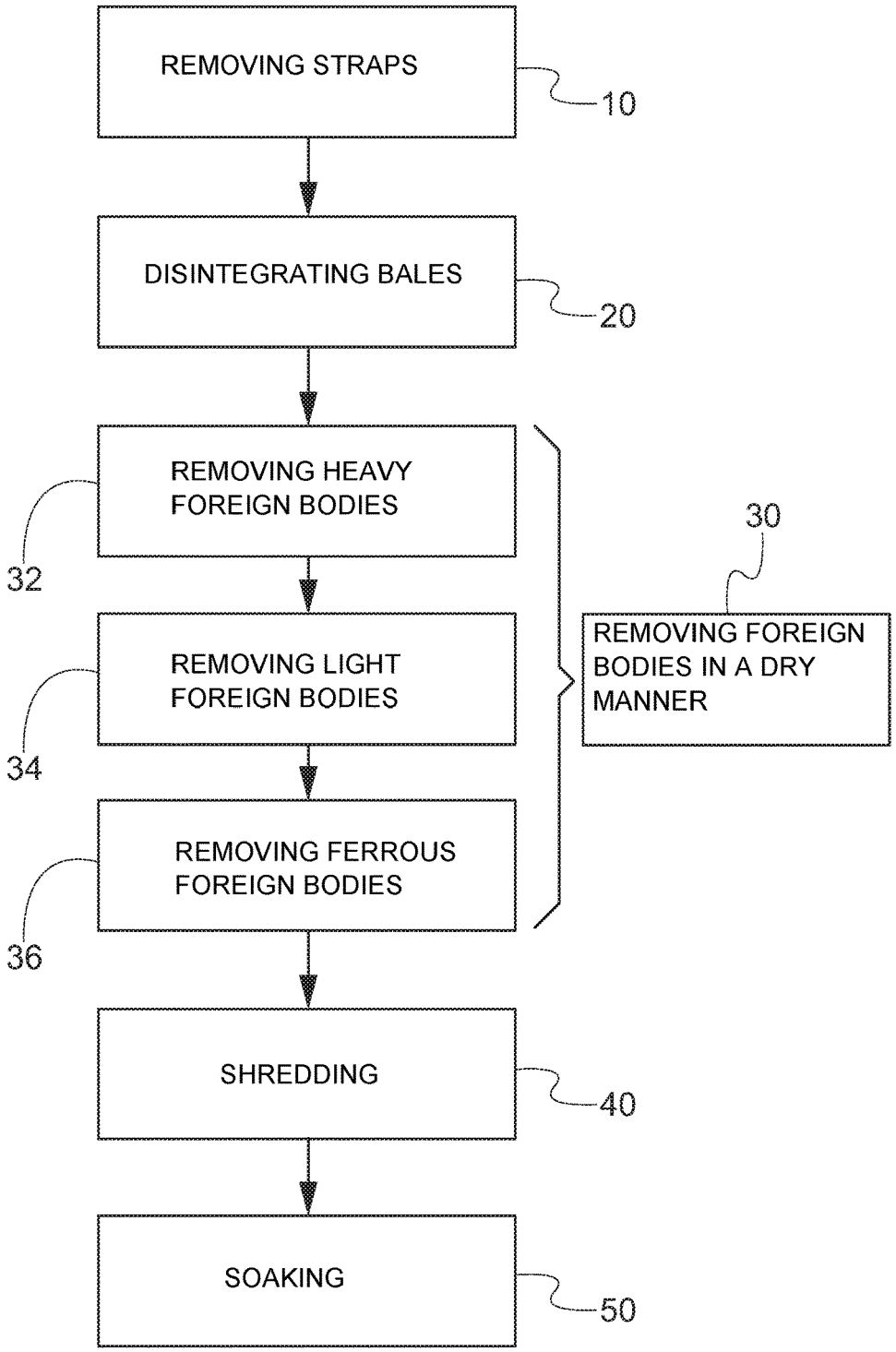
FIG. 1 is a block diagram schematically showing the main steps of the method according to the invention.

Referring initially to FIG. 1, the main steps of the method for pre-treating biomasses according to the invention are schematically illustrated in the form of a block diagram.

Specifically, in the illustrated example reference will be made to the pre-treatment of non-food biomasses, particularly of wheat straw and/or rice straw provided in bales.

In said example, the illustrated method may therefore comprise an initial step of strap removal 10 for removing the straps wound around the bales.

The thus freed bales are fed to a shredding step 40.

According to the invention, prior to the shredding step 40 the method for pre-treating biomasses comprises a soaking step 30.

Said soaking step preferably includes several separate sub-steps for removing foreign bodies of different kinds. More particularly, a sub-step for removing heavy foreign bodies 32 and a separate sub-step for removing light foreign bodies 34 may be provided. In addition, a separate sub-step 36 for removing metallic foreign bodies, especially ferrous ones, may be provided.

Advantageously, said step of removing foreign bodies 30 is preferably preceded by a step of disintegrating bales 20, during which the bales are disaggregated so as to spread the straw and expose the foreign bodies contained therein, thus facilitating removal thereof. Said step of disaggregating bales 20 plays a very relevant role, as it allows to eliminate possible lumps of material that would make it difficult—if not impossible—to subsequently remove foreign bodies, especially when such removal of foreign bodies is effected by means of aeraulic means.

Preferably, at the end of the step of disintegrating bales 20, the biomass is in the form of a layer having a substantially uniform thickness of no more than 100 mm.

The thus cleaned biomass (straw) is at last subjected to the shredding step 40.

It will be evident to the person skilled in the art that due to the fact that light and heavy foreign bodies have been previously removed, on one hand the production of dusts during the shredding step 40 is drastically reduced and on the other hand the risk of failures or malfunctioning during this shredding step 40 as well as wear of the used devices are remarkably reduced.

Preferably, according to the invention, the biomass shredding step 40 is a step of shredding by cutting.

The fact that the biomass is cut—instead of being for instance subjected to sieving, as happens in commonly used hammer shredders—allows to obtain higher homogeneity in the size of the shredded biomass thus obtained.

In particular, the size of the biomass obtainable with the method according to the invention is approximately 80-140 mm.

In particular, in the case of the pre-treatment of wheat straw and/or rice straw, shredding by cutting allows to prevent very long straw stalks from being left inside the biomass during the subsequent processing steps.

According to the invention, the biomass, before being fed to subsequent processing steps, undergoes a soaking step 50.

Said soaking step 50 preferably takes place downstream of the shredding step 40, as illustrated in the preferred embodiment shown in FIG. 1.

However, a soaking step upstream of the shredding step 40 may also be provided.

Said soaking step 50, during which the biomass is soaked with water preferably having a high temperature and possibly mixed with appropriate chemicals, contributes to destroy the structure of the biomass itself and promotes subsequent processing thereof.

In addition, during the soaking step 50 dusts and other fine foreign bodies that may possibly have remained in the biomass even after the step of removing foreign bodies 30 can be further removed.

Said dusts and fine foreign bodies might for instance be removed by means of one or more sludge pump(s).

The thus shredded and soaked straw is ready for being fed to a plant for subsequent processing, for instance to a biorefinery for producing bioethanol.

Figure 2:
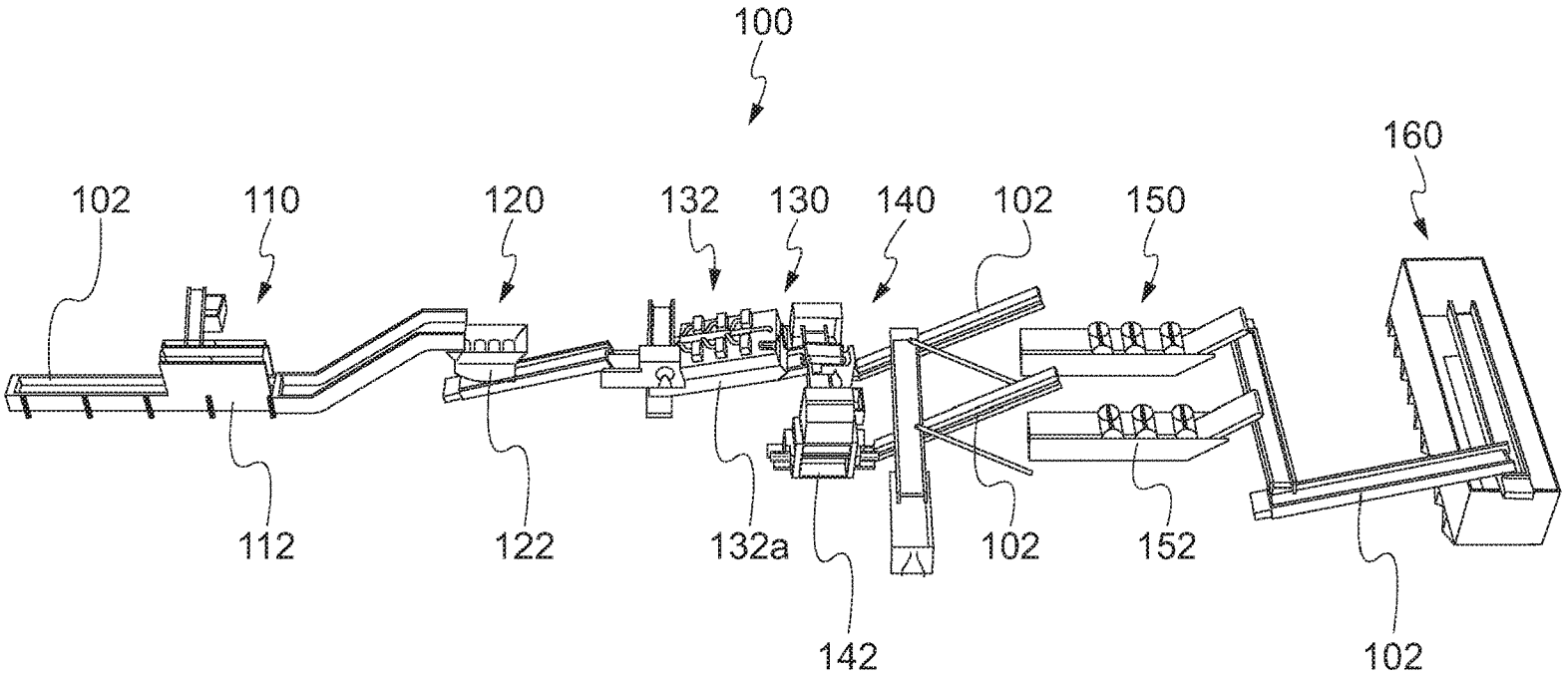
FIG. 2 is a perspective view schematically showing a plant according to the invention capable of implementing the method of FIG. 1.
Figure 3:
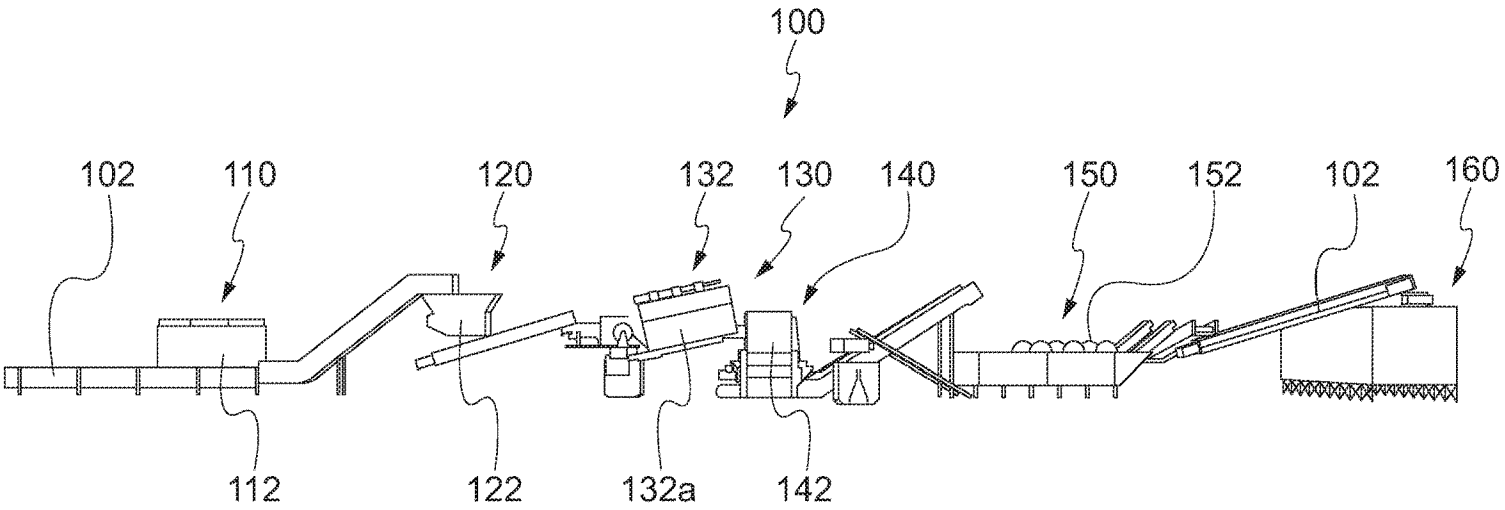
FIG. 3 is a side view of the plant of FIG. 2.

In FIGS. 2 and 3 there is schematically illustrated an example of a plant for treating biomasses 100 according to the invention.

Said plant for treating biomasses 100 comprises a transport line 102 consisting of one or more conveyor belt(s) and a plurality of working stations 110-160 arranged along said transport line.

In this case, too, reference will be made particularly, though in a non-limiting way, to the pre-treatment of wheat straw and/or rice straw provided in bales.

The first station that the straw bales advancing on the transport line 102 encounter during their travel is therefore preferably a station for removing straps 110 that comprises one or more strap-removing machine(s) 112.

Downstream, it is possible to provide for the presence of a station for disintegrating bales 120 which is capable of disintegrating the bales and spreading the straw on the transport line 102, thus exposing the foreign bodies contained therein and facilitating subsequent removal thereof. Said disintegration station 120 may comprise for instance one or more suitably arranged feed screw(s) 122.

As mentioned above, when exiting the disintegrating station 120, the straw will be spread on the transport line 102 in a layer having a substantially uniform thickness of no more than 100 mm.

According to the invention, the plant for treating biomasses further comprises a station for removing foreign bodies 130.

In particular, in the embodiment shown in FIGS. 2 and 3, the station for removing foreign bodies 130 comprises at least one sub-station 132 for removing heavy foreign bodies; said station may be for instance provided with one or more aeraulic separator(s) 132*a*.

Aeraulic separators use air flows for separating light parts (i.e. biomasses and light foreign bodies that may be contained therein), from heavy foreign bodies such as rocks or soil lumps.

A sub-station for removing light foreign bodies may also be provided; said station might be for instance provided with one or more suitably sized sieve(s).

In addition, a further sub-station (not shown) for removing metallic foreign bodies, especially ferrous ones, provided with suitable magnetic means may be provided.

In alternative, it will be possible to provide that one of the conveyor belts of the transport line 102 is a magnetic belt, so as to effect removal of ferrous foreign bodies directly during advance of the straw on said transport line.

The thus cleaned straw finally moves forward to the shredding station 140, where it is cut to pieces.

Advantageously, according to a preferred embodiment of the invention, said shredding station 140 comprises one or more blade shredder(s) 142 or similar cutting devices.

Using blade shredders allows a more homogeneous size in terms of dimensions of the obtained shredded biomass and, in particular, it prevents long straw stalks from remaining uncut.

As mentioned above, when exiting the shredding station 140, the straw will have a substantially homogeneous size comprised between 80 and 140 mm.

The plant according to the invention further comprises, downstream of the shredding station 140, a soaking station 150 comprising one or more soaking vessel(s) 152, in which the straw is advanced immersed in water, preferably having a high temperature and possibly mixed with appropriate chemicals (for instance ammonia).

Such soaking station may possibly be provided upstream of the shredding station, between the station for removing foreign bodies and said shredding station.

Advantageously, during passage through the soaking vessel 152, not only does the straw becomes soaked with water, which contributes to destroy the structure of the biomass itself, but effective removal of fine foreign bodies (dusts) that may possibly have remained in the biomass is also obtained.

In this respect, the soaking vessels 152 may be provided with suitable means (not shown) for removing said foreign bodies. In particular, the soaking vessels 152 may be provided with one or more sludge pump(s) adapted to remove dusts and other fine foreign bodies remaining in suspension inside said soaking vessels 152.

The thus shredded and soaked straw is further conveyed by means of conveyor belts of the transport line 102 to the subsequent processing plants, possibly after being stored in a suitable storage station 160.

Said storage station 160 may comprise for instance a tank provided with suitable means for handling, dosing and extracting the shredded straw.

The plant described in FIGS. 2 and 3 may comprise an appropriate system for feeding the biomass to the transport line 102.

Said feeding system may for instance provide for a storage site and handling means for moving the biomass to be treated from said storage site to the pre-treating plant 100.

Preferably said storage site may comprise a simple storage area and an aerated storage area for dehydrating the biomass having a high moisture content, so as to avoid acetic and lactic fermentation thereof.

The handling devices may preferably comprise one or more overhead travelling crane(s) arranged above the storage site and translationally movable along a direction or, even better, along two orthogonal directions. Said travelling cranes can thus move above the storage site and pick up, in a simple and reliable manner, the desired biomass to be fed to the pre-treating plant 100 (independently of the order in which the biomasses arrive at the storage site).

From the above description, it is evident that the method and the plant according to the invention allow to reach the objects set forth above.

Indeed, with the pre-treatment provided in the method and the plant according to the invention, the biomass at the time of shredding is substantially free from foreign bodies, and in particular from dusts and foreign bodies that may cause jamming, failures and malfunctioning of the devices intended for shredding the biomass.

In addition, at the end of the pre-treatment provided for by the method and the plant according to the invention, the biomass is shredded in pieces having homogeneous size and with the cellulose contained therein fully available for subsequent treatments, especially for the subsequent fermentation in case said biomass is used for producing biofuels.

It is further evident that what has been described above with respect to the preferred embodiments of the method and plant according to the invention has been provided merely by way of example and that several variants and modifications can be made on the basis of the common knowledges of the person skilled in the art without departing from the scope of protection as defined in the appended claims.

In particular, although reference has been made above to the pre-treatment of wheat straw and/or rice straw, it is evident that the invention can be equally applied both to food and non-food biomasses of different kind.

In addition, although reference has been made above to the pre-treatment of biomasses intended for biorefineries for producing biofuels, it is evident that the invention can be used for pre-treating biomasses intended for other purposes, whenever it is deemed necessary or convenient for the good outcome of the subsequent processing operations to free said biomasses from the foreign bodies contained therein.

The invention claimed is:

1. A plant of treating biomasses provided in bales, comprising a transport line on which the biomasses are moved forward and a plurality of working stations arranged along the transport line, wherein:

at least one shredding station is arranged along the transport line, a station for removing foreign bodies is provided along the transport line, upstream of the shredding station, a station for disintegrating bales of biomasses and spreading the biomasses on the transport line is provided along the transport line, upstream of the station for removing foreign bodies, and a soaking station comprising one or more soaking vessel(s) for soaking the biomasses is provided along the transport line, downstream of the shredding station, wherein the soaking station comprises a device for removing fine foreign bodies and dusts, said device comprising at least one sludge pump arranged in the one or more soaking vessel(s).

2. The plant according to claim 1, wherein the station for removing foreign bodies comprises at least one sub-station adapted for removing heavy foreign bodies.

3. The plant according to claim 2, wherein the sub-station for removing heavy foreign bodies comprises one or more aeraulic separators.

4. The plant according to claim 2, wherein the station for removing foreign bodies further comprises at least one sub-station adapted for removing light foreign bodies.

5. The plant according to claim 4, wherein the station for removing foreign bodies further comprises a sub-station for removing ferrous foreign bodies, the sub-station for removing ferrous foreign bodies being provided with magnetic devices for removing the ferrous foreign bodies.

6. The plant according to claim 2, wherein the station for removing foreign bodies further comprises a sub-station for removing ferrous foreign bodies, the sub-station for removing ferrous foreign bodies being provided with magnetic devices for removing the ferrous foreign bodies.

7. The plant according to claim 1, wherein the shredding station comprises one or more blade shredder(s) or similar cutting devices.

8. The plant according to claim 1, further comprising a system for feeding the biomasses to the plant, wherein the feeding system comprises a storage site and handling devices for moving the biomasses to be treated from the storage site to the plant and wherein the handling devices comprise one or more overhead travelling crane(s) arranged above the storage site and movable by translation along one or more direction(s).

* * * * *